US007017315B2

(12) United States Patent
Corwin

(10) Patent No.: US 7,017,315 B2
(45) Date of Patent: Mar. 28, 2006

(54) PROCESS AND APPARATUS FOR INSULATING BUILDING ROOF

(76) Inventor: Thomas N. Corwin, 3713 Five Mile Rd., Traverse City, MI (US) 49686

( * ) Notice: Subject to any disclaimer, the term of this patent is extended or adjusted under 35 U.S.C. 154(b) by 0 days.

(21) Appl. No.: 10/007,863

(22) Filed: Nov. 5, 2001

(65) Prior Publication Data

US 2003/0205023 A1 Nov. 6, 2003

(51) Int. Cl.
*E04B 1/74* (2006.01)

(52) U.S. Cl. ..... 52/407.3; 52/407.1; 52/407.4; 52/404.2; 52/404.5; 52/745.06

(58) Field of Classification Search ..... 52/749.12, 52/746.11, 404.1, 202, 203, 90.1, 92.1, 36, 52/36.4, 743, 407.1, 407.3, 407.4, 404.2, 52/489.1, 489.2, 696, 404.5, 800.1, 800.11, 52/800.12, 745.06; 248/300, 220.1, 244
See application file for complete search history.

(56) References Cited

U.S. PATENT DOCUMENTS

| | | | | |
|---|---|---|---|---|
| 1,535,504 | A | | 4/1925 | Stephens |
| 1,997,580 | A | | 4/1935 | Gibson et al. |
| 1,997,605 | A | | 4/1935 | Strom et al. |
| 2,289,469 | A | | 7/1942 | Turner |
| 2,999,278 | A | * | 9/1961 | Spencer et al. ..... 52/479 |
| 4,014,150 | A | | 3/1977 | Wells et al. |
| 4,375,741 | A | * | 3/1983 | Paliwoda ..... 52/109 |
| 4,379,381 | A | * | 4/1983 | Holcombe ..... 52/404.3 |
| 4,479,339 | A | * | 10/1984 | Kroh ..... 52/144 |
| 4,566,239 | A | * | 1/1986 | Smigel et al. ..... 24/460 |
| 4,642,963 | A | * | 2/1987 | Borges ..... 52/481.2 |
| 4,724,651 | A | * | 2/1988 | Fligg ..... 52/407.3 |
| 4,860,502 | A | * | 8/1989 | Mickelsen et al. ..... 52/11 |
| 4,949,929 | A | * | 8/1990 | Kesselman et al. ..... 248/220.1 |
| 5,058,352 | A | * | 10/1991 | Loiselle et al. ..... 52/404.2 |
| 5,074,090 | A | * | 12/1991 | Hafers ..... 52/406.3 |
| 5,239,790 | A | * | 8/1993 | Fetzer ..... 312/245 |
| 5,535,566 | A | * | 7/1996 | Wilson et al. ..... 52/393 |
| 5,561,959 | A | * | 10/1996 | Alderman et al. ..... 52/404.1 |
| 5,758,464 | A | * | 6/1998 | Hatton ..... 52/404.1 |
| 6,164,019 | A | * | 12/2000 | Salley ..... 52/11 |
| 6,393,785 | B1 | * | 5/2002 | Burt ..... 52/11 |

* cited by examiner

*Primary Examiner*—Carl D. Friedman
*Assistant Examiner*—Jennifer I. Thissell

(57) ABSTRACT

An improved process and apparatus for insulating a building roof involves the use of a rigid thermal insulating panel supported between roof rafters. Brackets fastened to the rafters are used to support the rigid thermal insulating panels at a predetermined distance from the roof to provide an appropriate ventilation gap between the roof and the insulation.

8 Claims, 2 Drawing Sheets

PROCESS AND APPARATUS FOR INSULATING BUILDING ROOF

FIELD OF THE INVENTION

This invention relates to building insulation and more particularly to processes and apparatus for thermally insulating a roof and/or floor of a building.

BACKGROUND OF THE INVENTION

Residential building roofs are typically insulated by laying glass fiber insulation batts onto drywall panels after the drywall panels have been fastened to the roof rafters. Because glass fiber insulation batts are pliable and compressible, it can be difficult to install a uniformly thick layer of glass fiber insulation that completely covers the drywall panels forming the ceiling. Further, it is difficult to provide a uniformly thick space or gap between the insulation and the roof for proper ventilation. These problems are especially difficult to overcome when wires, electrical boxes or other obstructions are located in the space between the ceiling and the roof. In the area of such obstructions, the glass fiber insulation batts tend to bunch up. This has two undesirable effects. First, any areas of the ceiling which are not covered with insulation will allow high rates of heat transfer and very substantially negate the potential benefits of the insulation. Second, bunching up of the insulation can effectively block off ventilation in a portion of the space between the ceiling and the roof, which in turn can result in ice back up under the shingles at the eaves.

When building construction is undertaken during the winter in cold climates, it is common practice to attempt to install the ceiling drywall and insulation as soon as possible to allow efficient heating of the building to facilitate interior construction operations such as electrical work, plumbing, drywall installation on interior walls, painting, etc. A problem with this practice is that any plumbing, electrical, mechanical, ductwork, etc. that is to be installed between the ceiling drywall panels and the roof must be roughed in before the ceiling drywall panels can be installed. If this preliminary work, which is necessary before installation of the ceiling drywall panels, is not completed before the onset of cold weather then it may become necessary to delay this work until the weather warms up to avoid the difficulties and expenses associated with heating an uninsulated building and/or completing such work in an unheated building.

It is an object of this invention to provide improved processes and apparatus for insulating a building roof. In particular, an object of this invention is to facilitate easier installation of thermal insulation between a building roof and ceiling while ensuring a uniform thickness of insulation and a uniformly thick ventilation gap between the insulation and roof without undesirable gaps in the insulation which reduce efficiency, and without any blockages in the ventilation space between the insulation and the roof which could lead to ice backup under the roof shingles.

Another object of this invention is to provide processes and apparatus that allow installation of thermal roof insulation immediately after the roof rafters have been erected. This allows sufficient heating of the building before installation of the ceiling drywall panels and before any plumbing, electrical, mechanical, ductwork or other building materials are roughed in between the drywall and the roof. As a result, the processes and apparatus of this invention allow greater flexibility in scheduling construction and avoiding construction delays during inclemently cold weather.

U.S. Pat. No. 2,289,469 discloses a building construction panel employed in making walls, floors or ceiling units. The panels comprise a cap piece and a sill. Fillers are placed in position and held without separate fasteners. The fillers are fireproof panels, not thermal insulation panels.

U.S. Pat. No. 4,566,239 discloses an insulation system for insulating a metal roof. The insulation system includes a plurality of elongated bodies of insulating material, such as insulating boards. The insulating boards are suspended from purlins by flexible sheets.

Neither of the above referenced U.S. patents describes insulation processes and apparatus that facilitate easy installation of thermal insulation between a building roof and a ceiling while ensuring a uniform thickness of insulation and a uniformly thick ventilation gap between the insulation and the roof without undesirable gaps in the insulation and without blockages in the ventilation space. Further, neither of these patents facilitates installation of thermal roof insulation immediately after the roof rafters have been erected and before the ceiling drywall panels have been installed and before any plumbing, electrical, mechanical, ductwork and other building materials have been roughed in between the drywall and roof.

SUMMARY OF THE INVENTION

The invention provides improved processes and apparatus for insulating a building, and in particular for insulating a building roof.

In accordance with an aspect of the invention, a building roof supported on rafters is insulated by supporting a rigid insulating panel between the rafters. The rigid insulation panels can be easily installed before installation of a ceiling, and do not have any tendency to bunch up. These features have the advantage that efficient and complete thermal insulation of a building roof can be completed quickly and easily, and before installation of a ceiling.

In accordance with another aspect of the invention, there is provided improved apparatus for insulating a building, which for example allows installation of thermal roof insulation immediately after roof rafters have been erected. The apparatus includes a rigid insulation panel and at least one bracket attached on each of two opposite sides of the insulation panel. Each bracket has at least a portion that projects outwardly away from a surface of the rigid foam panel, whereby the apparatus can be supported on a building structure by fastening the projecting portion of each bracket to a building structure.

These and other features, advantages and objects of the present invention will be further understood and appreciated by those skilled in the art by reference to the following specification, drawings and claims.

DESCRIPTION OF THE PREFERRED EMBODIMENTS

Figure 1:
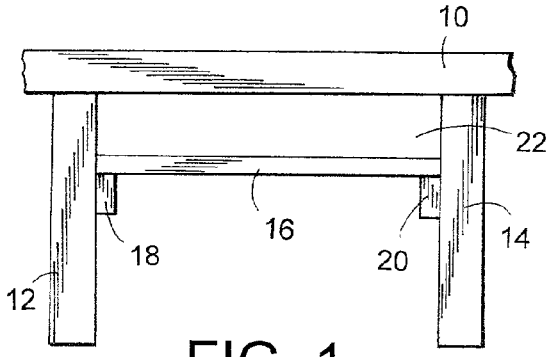
FIG. 1 is an elevational view of a thermally insulated roof in accordance with the invention described herein.

In FIG. 1, there is shown a building roof 10 supported on rafters 12 and 14. The roof is thermally insulated by supporting a rigid insulation panel 16 below roof 10 and between rafters 12 and 14. An insulation panel 16 can be supported on brackets 18 and 20 fastened to rafters 12 and 14 respectively. Brackets 18 and 20 may be in the form of rails that extend the length of rafters 12 and 14, or brackets 18 and 20 may be relatively short (e.g., one to three inches), with one bracket supporting each of the four corners of a panel 16. Although the process used for insulating a building roof in accordance with the structure shown in FIG. 1 has advantages over the use of alternative methods utilizing glass fiber batt, a disadvantage is that care must be taken to install brackets 18 and 20 on rafters 12 and 14, respectively, at a desired distance from the underside of roof 10 so that insulation panel 16 is spaced from roof 10 to provide an appropriate ventilation gap 22, wherein the upper surface of panel 16 is uniformly spaced from the underside of roof 10 by a predetermined distance, typically about one inch.

Figure 2:
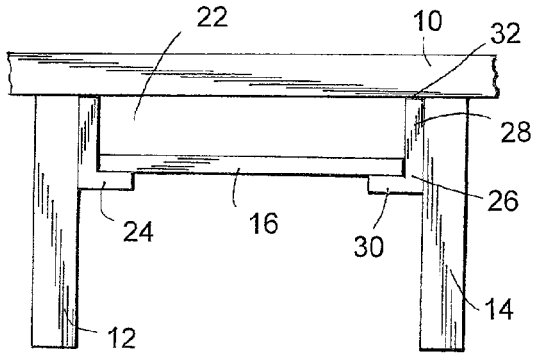
FIG. 2 is an elevational view of a thermally insulated roof utilizing L-shaped brackets that support an insulating panel at a predetermined distance from the roof.

In order to reduce the amount of effort needed to accurately space thermal insulating panel 16 from roof 10, L-shaped brackets 24 and 26 are used as shown in FIG. 2. The L-shaped brackets 24 and 26 have a vertical arm 28 and a horizontal arm 30 for supporting panel 16. The vertical arm 28 has a predetermined length equal to the sum of the thickness of the rigid insulating panel 16 and ventilation gap 22 (typically about one inch). Brackets 24 and 26 may be fastened to rafters 12 and 14, respectively, such as with an adhesive, nails, screws, or the like, or combinations thereof, with the upper end 32 of arm 28 abutting the underside of roof 10.

Figure 3:
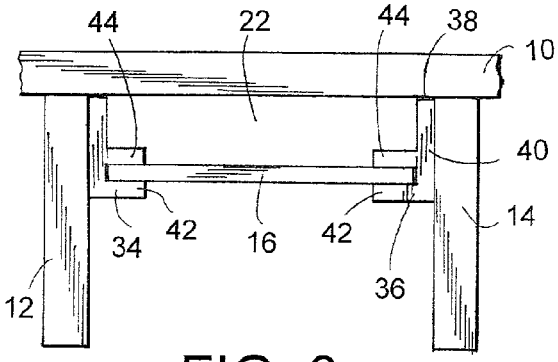
FIG. 3 is an elevational view of a thermally insulated roof in which F-shaped brackets are used for retaining an insulation panel at a predetermined distance away from a roof.

FIG. 3 shows an alternative arrangement in accordance with the principles of this invention, wherein F-shaped brackets 34 and 36 are used for supporting thermal insulating panel 16 on rafters 12 and 14, respectively, at a predetermined distance from roof 10 to provide a ventilation gap 22. As with the structure shown in FIG. 2, and upper end 38 of vertical leg 40 of the brackets abuts the underside of roof 10. The use of brackets 34 and 36 having a leg 40 of a predetermined length enables easy installation of panels 16 below roof wherein each panel 16 is spaced from the underside of roof 10 by a predetermined desired distance (typically about one inch). An advantage with the F-shaped brackets shown in FIG. 3 is that thermal insulating panel 16 can be more securely retained between horizontal arms 42 and 44.

Figure 4:
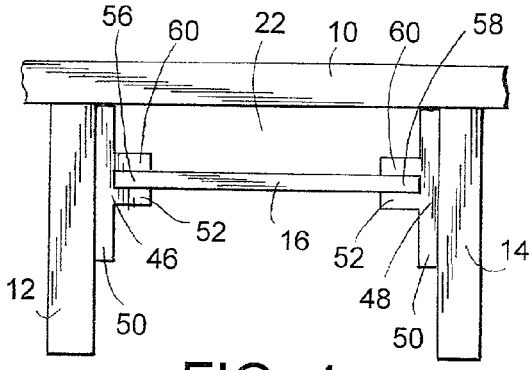
FIG. 4 is an elevational view of a thermally insulated roof utilizing Π-shaped brackets for retaining an insulating panel at a predetermined distance from a roof.

FIG. 4 shows another variation of the insulated roof structure shown in FIG. 3, wherein Π-shaped brackets 46 and 48 are used rather than the F-shaped brackets shown in FIG. 3. A further advantage of Π-shaped brackets 46 and 48 is that the dimensions of brackets 46 and 48 can be selected so that they can be fastened to rafters 12 and 14, respectively, in either of two different, equivalent orientations. For example, the Π-shaped brackets 46 and 48 can be configured to be symmetrical with respect to a plane parallel with and centered between the major faces (i.e., upwardly directed face and downwardly directed face) of thermal insulating panel 16.

Another advantage with the Π-shaped brackets shown in FIG. 4, is that the portion 50 of the Π-shaped bracket that extends downwardly from the lower horizontal arm 52 is available for fastening the Π-shaped brackets to the ceiling rafter. Accordingly, it would be possible to easily install insulating panel 16 below roof 10 as shown in FIG. 4 by first inserting opposite edges 56 and 58 into the channel defined between upper and lower horizontal arms 52 and 60 to form an assembly that is positioned as shown in FIG. 4 and thereafter fastening the brackets to rafters 12 and 14 by driving a nail, screw or other fastener through portions 50 of the Π-shaped brackets (46, 48).

For any of the insulated roof structures shown in FIGS. 1–4, the brackets (18 and 20, 24 and 26, 34 and 36, or 46 and 48) can be first attached to rafters 12 and 14 with panel 16 thereafter mounted on or retained by the brackets. Alternatively, it is the brackets may first be secured to panel 16 (such as with an adhesive), and thereafter the brackets may be secured to the rafters. Other means for preattachment of the brackets to panel 16 before attaching the brackets to rafters 12 and 14 include thermal fusion, welding, etc.

Figure 5:
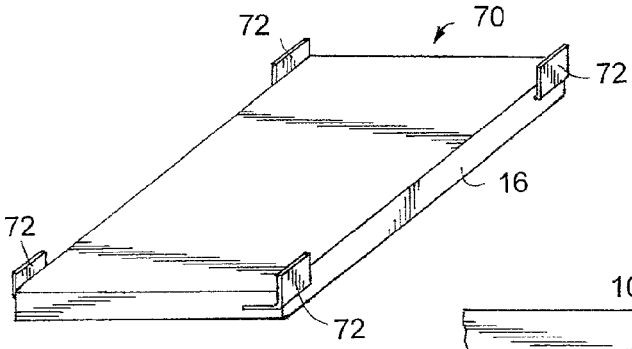
FIG. 5 is a perspective view of a first embodiment of an apparatus for insulating a building in accordance with the invention.
Figure 6:
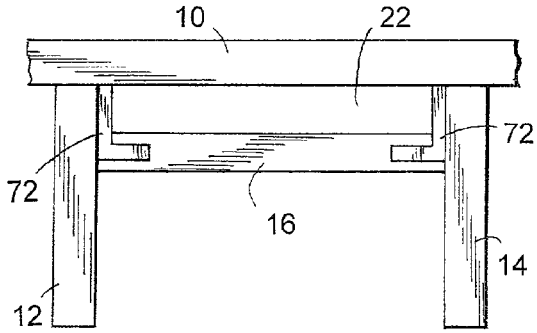
FIG. 6 is an elevational view showing the apparatus of FIG. 5 used for insulating a building roof.

As shown in FIGS. 5 and 6, an apparatus 70 for thermally insulating a building, and in particular a roof, includes a rigid thermal insulation panel 16 with integrally attached brackets. In the embodiment shown in FIG. 5, an L-shaped bracket 72 is embedded at each of the four corners of rectangular thermal insulating panel 16. As shown in FIG. 6, thermal insulation apparatus for assembly 70 can be installed as a unit below roof 10 by positioning assembly 70 as shown in FIG. 6. and fastening integrally attached brackets 72 to rafters 12 and 14.

Figure 7:
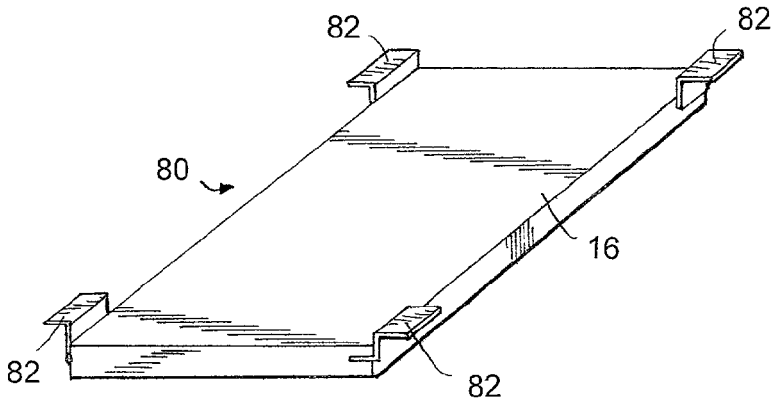
FIG. 7 is a perspective view of a second embodiment of an apparatus for insulating a building in accordance with the invention.
Figure 8:
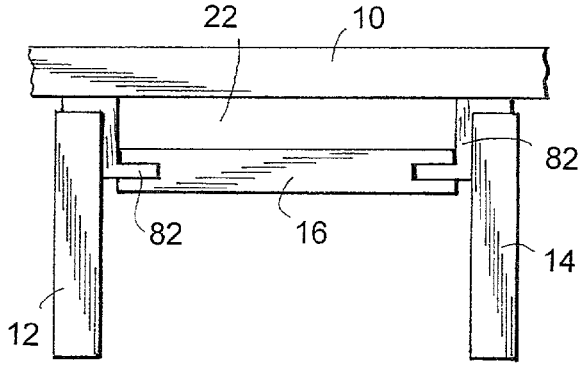
FIG. 8 is an elevational view of the apparatus show in FIG. 7 used for insulating a building roof.

FIGS. 7 and 8 show an alternative building insulation apparatus or assembly comprising a thermal insulation panel 16 and integrally attached Z-shaped fasteners 82. As can be understood by referencing FIG. 8, this particular embodiment of the invention is installed on rafters 12, 14 before roof 10 is secured to the rafters.

Figure 9:
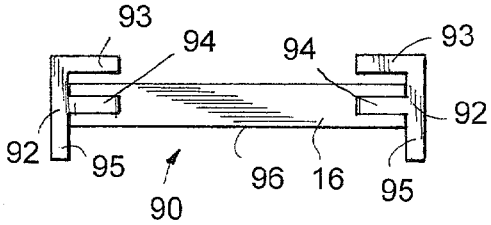
FIG. 9 is an elevational view of a third embodiment of a thermal insulation apparatus useful for insulating a building.
Figure 10:
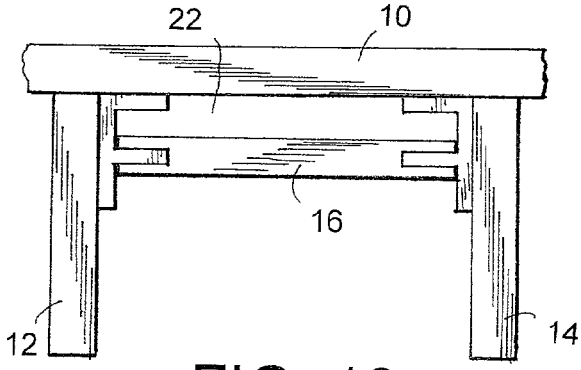
FIG. 10 is an elevational view of the apparatus of FIG. 9 installed at a roof of a building.

In accordance with another embodiment of the invention, a thermal insulation apparatus or assembly 90 for insulating a building is shown in FIG. 9. Assembly 90 includes a thermal insulating panel 16 and F-shaped brackets 92 integrally attached to panel 16. An advantage with this assembly is that the upper horizontal arm 93 of bracket 92 abuts the underside of roof 10 as shown in FIG. 10 to provide a desired predetermined ventilation gap 22. Horizontal arm 94 is embedded in panel 16. Preferably panel 16 is formed around arms 94. This can be achieved with inset and/or onset molding techniques. Another advantage with the structure shown in FIG. 9, is that the portion 95 of bracket 92 that extends downwardly below the underside 96 of panel 16 can be used for fastening brackets 92 to rafters 12 and 14. This allows very easy installation of assembly 90 between rafters 12 and 14 after roof 10 has been attached to rafters 12 and 14.

The rigid panels 16 used in the practice of this invention refer to panels that are relatively rigid as compared with fibrous batt insulation. Preferred thermal insulation panels include various thermoplastic and/or thermoset resins, particularly closed-cell plastic foams. Examples include rigid polyurethane foams, polyolefin foams, and polystyrene foams, with polystyrene foams being preferred.

The various brackets (18, 20, 24, 26, 34, 36, 46 and 48) may be made or any suitable material capable of being fastened to a roof rafter and supporting thermal insulation panel. Examples of suitable materials include various plastics and metals, such as steel.

In accordance with any of the embodiments described herein, at least two brackets are used to support each thermal insulation panel, with at least one bracket on each of two opposite edges of the thermal insulation panel. The brackets may be of generally any length, e.g., from about an inch up to the length of the panel.

Although the invention is believed to be particularly useful for thermally insulating under a building roof, the methods and apparatus of this invention may be employed in other insulation applications, such as below floors, especially floors located over an unheated crawl space.

The above description is considered that of the preferred embodiments only. Modifications of the invention will occur to those skilled in the art and to those who make or use the invention. Therefore, it is understood that the embodiments described above are merely for illustrative purposes and are not intended to limit the scope of the invention, which is defined by the following claims as interpreted according to the principles of patent law, including the doctrine of equivalents.

The invention claimed is:

1. A process of insulating and ventilating a building roof supported on rafters, comprising:

Providing a rigid insulation panel having an upwardly facing major surface, an opposing downwardly facing major surface, and opposite edge surfaces extending between the major surfaces, spanning between two rafters or trusses, the rigid insulation panel having at least two separate brackets, each of the two separate brackets attached to the rigid insulation panel at a different opposite edge surface of the rigid insulation panel, each bracket having an upwardly projecting portion extending from an edge surface of the rigid insulation panel above the upwardly facing major surface of the rigid insulation panel for spacing the rigid insulation panel from the bottom of a roof by a predetermined distance to achieve an air ventilation channel, and a downwardly projecting portion that extends sufficiently downwardly from the edge surface of the rigid insulation panel below the downwardly facing major surface of the rigid insulation panel to allow fastening of the bracket to rafters supporting a building roof; the bracket also has two spaced apart horizontal arms one top and one bottom gripping the rigid insulation panel holding it in place;

Positioning the rigid insulation panel with the attached brackets between rafters of a building so that the upper edges of the upwardly projecting portion of each of the brackets abut the bottom of an existing roof, whereby the rigid insulation panel is spaced from the roof by a predetermined distance to provide an air ventilation channel between the roof and the rigid insulation panel; and thereafter fastening the downwardly projecting portion of each of the brackets to the rafters, the rigid insulation panel being sufficiently rigid to maintain its shape while being supported between the rafters by the brackets attached at the edge surfaces of the rigid insulation panel.

2. The process of claim 1, wherein the rigid insulation panel comprises a polymeric foam.

3. The process of claim 1, wherein the rigid insulating panel comprises a closed-cell polymeric foam.

4. The process of claim 1, wherein the rigid insulating panel comprises a polystyrene foam.

5. An apparatus for insulating and ventilating a building roof supported on rafters, comprising:

Providing a rigid insulation panel having an upwardly facing major surface, an opposing downwardly facing major surface, and opposite edge surfaces extending between the major surfaces; spanning between two rafters or trusses, the rigid insulation panel having at least two separate brackets, each of the two separate brackets attached to a different opposite edge surface of the rigid insulation panel; each bracket having an upwardly projecting portion extending from an edge surface of the rigid insulation panel above the upwardly facing major surface of the rigid insulation panel for spacing the insulation panel from a roof by a predetermined distance, to create an air ventilation channel, and a downwardly projecting portion that extends sufficiently downwardly from the edge surface of the rigid insulation panel below the downwardly facing major surface of the rigid insulation panel to allow fastening of the bracket to rafters supporting a building roof: the bracket also has the spaced apart horizontal arms one top and one bottom gripping the rigid insulation panel as to hold it in place;

the rigid insulation panel being sufficiently rigid to maintain its shape while the rigid insulation panel is supported between rafters by the brackets attached at the edge surfaces of the rigid insulation panel.

6. The apparatus of claim 5, wherein the rigid insulating panel comprises a polymeric foam.

7. The apparatus of claim 5, wherein the rigid insulating panel comprises a closed-cell polymeric foam.

8. The apparatus of claim 5, wherein the rigid insulating panel comprises a polystyrene foam.

* * * * *